US005930839A

United States Patent [19]

Schupp

[11] Patent Number: 5,930,839

[45] Date of Patent: Aug. 3, 1999

[54] GOLF HEADGEAR AND BALL MARKER

[76] Inventor: Robert J. Schupp, 8317 Bald Eagle La., Wilmington, N.C. 28405

[21] Appl. No.: 09/015,650

[22] Filed: Jan. 29, 1998

[51] Int. Cl.[6] ..... A42B 1/24

[52] U.S. Cl. ..... 2/209.13; 2/244; 2/425

[58] Field of Search ..... 2/195.1, 209.13, 2/244, 246, 425; 40/329; 224/918

[56] References Cited

U.S. PATENT DOCUMENTS 3,753,519 8/1973 Gammon .
3,895,797 7/1975 Moore .
4,893,739 1/1990 Conner .
5,452,479 9/1995 Mostert .
5,539,929 7/1996 Revson .
5,581,813 12/1996 Henschel .

*Primary Examiner*—Diana L. Oleksa
*Attorney, Agent, or Firm*—Rhodes, Coats & Bennett L.L.P.

[57] ABSTRACT

A golf cap or other headgear that includes a horizontal slit of a given width, and a first indicia with an upper segment on the headgear above the slit. A ball marker having a second indicia corresponding to at least a part of the upper segment of said first indicia is inserted into the slit, so that a complete indicia is visible, whether or not the ball marker is present.

20 Claims, 3 Drawing Sheets

GOLF HEADGEAR AND BALL MARKER

BACKGROUND OF THE INVENTION (1) Field of the Invention

The present invention relates generally to improved headgear, and in particular to a golf cap or other golfer headgear that includes a recess holding a ball marker.

(2) Description of the Prior Art

In marking the position of a ball on a putting green so that the ball will not interfere with the play of another golfer, the usual practice is to temporarily replace the ball with a small marker that will show the ball's correct position, but which will not significantly obstruct the golfer's view or the movement of the other ball. While markers can be of any design, they are usually in the shape of a small disk. Frequently, a coin is used by the golfer as a ball marker.

In many instances, however, the golfer will not have a coin handy for this purpose, or must fumble in his pocket to find a suitable coin, delaying play. To overcome this problem, various devices have been proposed for holding ball markers so that they will be readily available to the golfer. For example, U.S. Pat. No. 4,893,739 to Conner describes a pouch for holding a ball marker, golf tees and other items, that can be attached to the golfer's belt.

Another carrier described in U.S. Pat. No. 3,753,519 includes a clip to attach the carrier to an article of clothing or to a golf bag. U.S. Pat. No. 3,895,797 to Moore describes a ball marker that has a handle on one side and hook-and-loop material on the opposite side so that the ball marker can be attached to a hook-and-loop pad mounted on the bill of a cap.

All of the ball marker storage devices proposed to date, however, have been of limited acceptance since they either require the golfer to wear, or remember to carry, an additional piece of equipment, or are unattractive, or require a golf marker of an unusual design. Thus, there is still a need for a convenient means for a golfer to carry a ball marker of a more conventional design.

SUMMARY OF THE INVENTION

The present invention relates to headgear that includes a recess for holding a ball marker, which is preferably in the shape of a flat plate or disk. The term "disk" as used herein, is intended to mean an object with a thickness substantially less than its width. The disk may have a circular cross-section, or another shape. In addition, the headgear includes an indicia, e.g., a logo or trademark, placed to coincide with the ball marker recess, while the ball marker includes an outer surface with an indicia corresponding to at least a part of the indicia on the headgear. As a result, product logos or other advertising indicia are complete, whether or not the ball marker is in the recess. While caps and hats will be used to exemplify the headgear, it will be understood that other headgear, e.g., visors and the like, may be adapted to use the present invention.

More specifically, the headgear includes a pocket or other recess having a width that is at least equal to the smallest diameter of a ball marker that is inserted into the recess, and a depth sufficient to ensure that the ball marker will not become dislodged from the recess during normal activities. In most designs, the recess will have a depth equal to at least about one-half of the diameter of the ball marker, so that the upper segment of the marker will be exposed.

The recess may be in the form of a pocket on the interior of the headgear, with the opening into the pocket being a slit in the side of the headgear. Instead of a pocket, may be only a slit in the headgear above an interior headband. In this alternative, the ball marker is inserted into the slit and is supported inside the headband.

Of significant importance to the present invention is the placement of an indicia on the headgear over the opening into the recess, along with placement of a corresponding indicia on one or both surfaces of the ball marker. In other words, a first indicia, or a segment thereof, is placed above the opening in the headgear. A second indicia, which is compatible with the part of the first indicia that is above the opening, or a component thereof, is placed on at least one side of the ball marker. In order to be "compatible," the second indicia should be combinable with the exposed parts of the first indicia to make a complete design. For most purposes, the indicia on the ball marker will be the same as the indicia or indicia segment covered by the ball marker. However, it is to be understood that the ball marker indicia can be different from the indicia or indicia segment covered, thereby producing a different indicia when the ball marker is removed.

Different types of indicia may be used in the present invention. In most instances, the indicia will be like those commonly seen on sports-oriented headgear. For example, the indicia may be selected from the group consisting of product trademarks, logos of broadcast networks, and names or logos of golf courses. The indicia may be applied by sewing, e.g., embroidering, by screen printing, or by other known application methods.

Thus, when the ball marker is out of the recess, a complete indicia on the headgear is visible. When the ball marker is inserted into the recess, the ball marker covers all or a part of the first indicia. Thus, the indicia on the ball marker visually replaces a covered part of the first indicia, so that another complete indicia, which may be different from or the same as the initial indicia, is visible. In instances where the ball marker indicia is smaller than the headgear indicia, and comprised a part of the headgear indicia design, the ball marker indicia and the uncovered pat of the headgear indicia combine to form a complete design.

The ball marker will be in the form of a flat circular plate. However, it is within the scope of the invention to provide ball markers of other shapes, such as rectangles, triangle, etc. Also, the ball marker may be in the shape of the indicia on its surface. In addition, since a particular orientation of the ball marker may be desired in order to be properly aligned with the indicia on the headgear, the recess and ball marker may be shaped so that the ball marker may only be inserted into the recess when aligned in a particular manner.

For example, the ball marker may be comprised of an upper segment with an indicia and a lower segment insertable into the headgear recess through the slit, with the lower recess having a cross-sectional diameter the same or less than the width of the slit, and the upper segment having a cross-sectional diameter greater than the slit width.

The ball marker may be constructed of any suitable material, such as plastic or metal. The indicia may be applied in a known manner, such as screen printing or as an applique.

The headgear of the present invention may be of an otherwise conventional design with a fabric crown or headpiece that fits over the wearer's head, and a bill or brim that extends generally horizontally outward from the lower edge of the crown. Also, the headgear will normally include a band, often called a sweatband, on the interior, lower edge of the crown that can be used to support the ball marker as described herein.

Specifically, the lower edge of the band is normally sewn or otherwise joined to the lower edge of the crown and is turned upwardly to form an annular pocket around the interior of the headgear. Preferably, the slit is made in the side of the crown. To prevent raveling, the edges of the slit may be sewn, e.g., with a buttonhole type stitch, glued, or treated in other known ways.

In one embodiment of the invention, the recess is formed by making a slit or opening in the crown of the headgear below the level of the upper edge of the band. In this case, the ball marker, when inserted into the slit, will be supported in the band, eliminating the need for forming a separate pocket. The band may be joined, e.g., by sewing or gluing, to the interior of the crown at either side of the opening to limit movement of the ball marker within the band. Alternatively, a pocket may be positioned inside the headgear, with the pocket mouth being joined to the slit or opening.

Accordingly, one aspect of the present invention is to provide a headgear and ball marker assembly comprising headgear including a crown with a front and sides, the crown having an opening to receive a ball marker and a first indicia positioned over the opening; and a ball marker insertable into the opening, the marker having a second indicia thereon corresponding to at least a part of the first indicia.

Another aspect of the present invention is to provide headgear including a ball marker comprising a crown including a lower peripheral edge, and a generally horizontal ball marker slit above the edge; a first indicia on the headgear, the first indicia including an upper segment above the slit; and a ball marker insertable into the opening, the marker having a second indicia thereon corresponding to at least a part of the upper segment of the first indicia.

Still another aspect of the present invention is to provide a golf cap including a ball marker comprising a crown having a continuous lower edge, a front section and opposed side sections, one of the side sections including a generally horizontal slit of a give width, the crown including a first indicia with an upper segment above the slit; and a ball marker inserted into the slit, the ball marker having opposed planar faces, the shortest cross-sectional dimension across the faces being approximately equal to the slit given width, at least one of the faces including a second indicia identical to at least a part of the upper segment of the first indicia.

These and other aspects of the present invention will become apparent to those skilled in the art after a reading of the following description of the preferred embodiment.

DETAILED DESCRIPTION OF THE INVENTION

In the following description, terms such as horizontal, upright, vertical, above, below, beneath, and the like, are used solely for the purpose of clarity in illustrating the invention, and should not be taken as words of limitation. The drawings are for the purpose of illustrating the invention and are not intended to be to scale.

Figure 1:
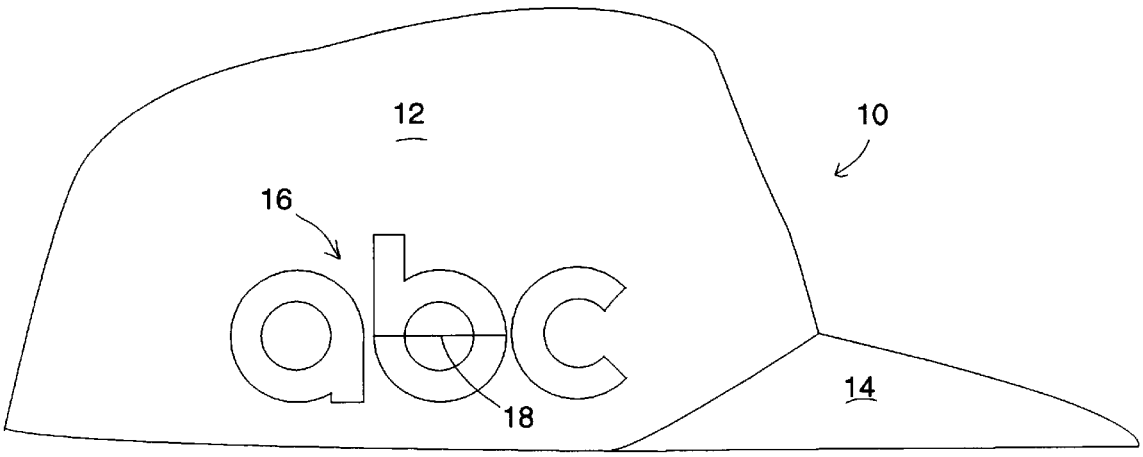
FIG. 1 is a side view of a cap with an indicia.
Figure 2:
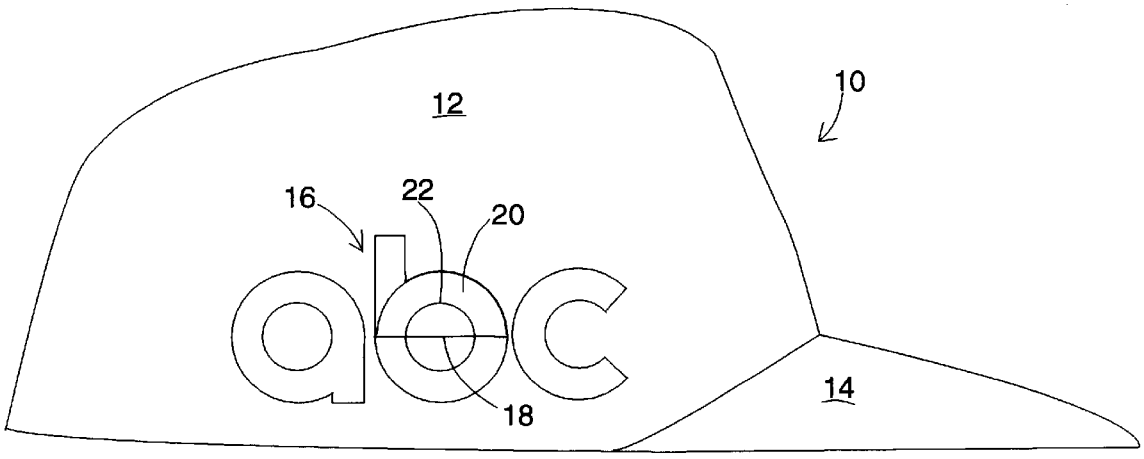
FIG. 2 is a side view of the cap of FIG. 1, with an inserted ball marker.

FIGS. 1 and 2 illustrate a preferred embodiment of the invention in which the headgear is a cap, generally 10, which includes a crown 12 and a bill 14. A headgear indicia 16 on the side of crown 12 is positioned over a ball marker recess 18. A ball marker 20 is shown inserted into slit 18 in FIG. 2. Ball marker 20 includes marker indicia 22 on its outer planar surface, with indicia 22 corresponding to the covered segment of indicia 16 above slit 18. Thus, as illustrated in FIG. 2, indicia 22 and indicia 16 cooperate to form the same design as shown in FIG. 1. Therefore, a complete predetermined design is visible whether or not marker 20 is present.

Figure 3:
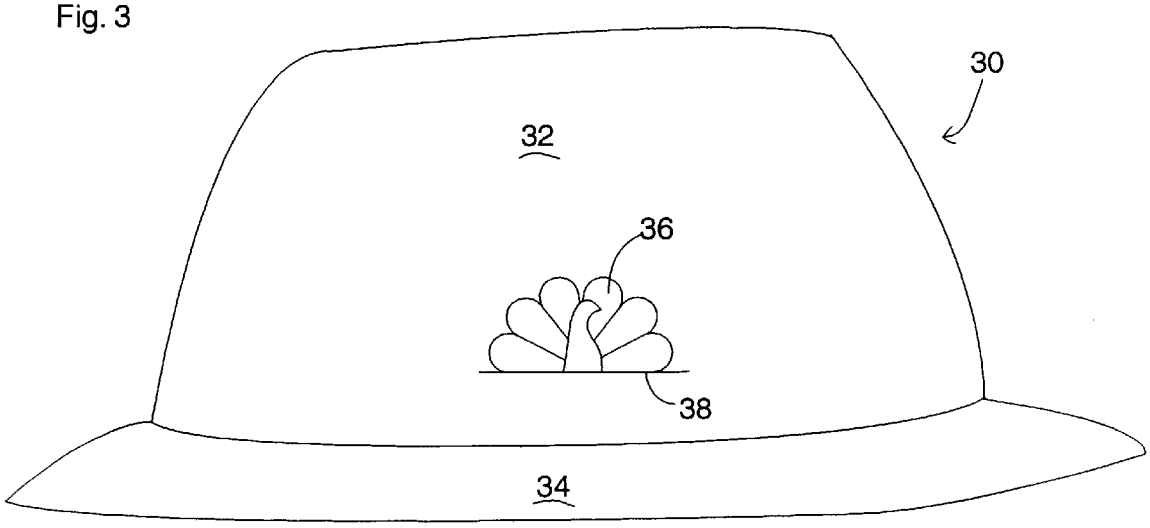
FIG. 3 is a side view of a hat with an indicia.
Figure 4:
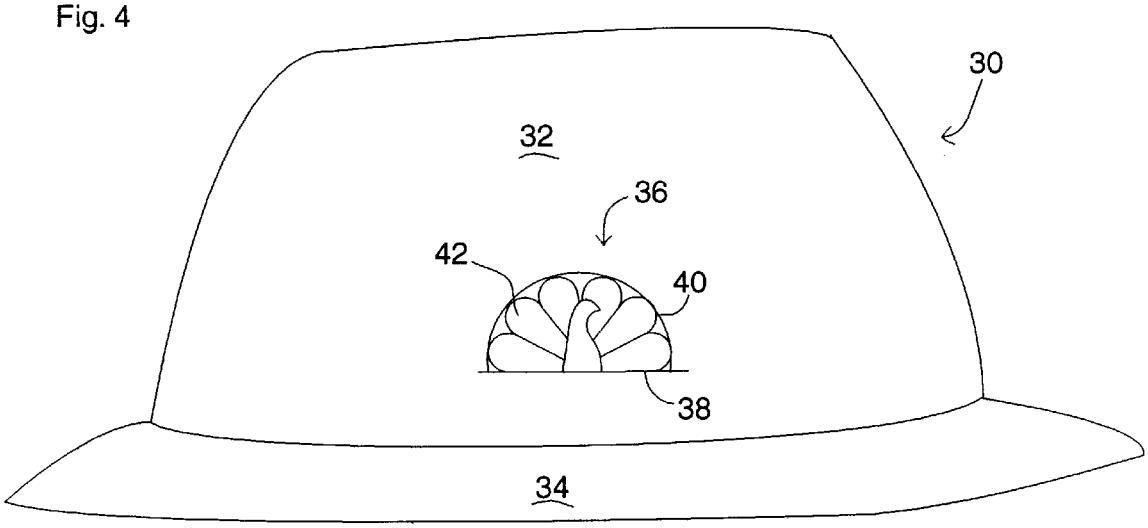
FIG. 4 is a side view of the hat of FIG. 3, with an inserted ball marker.

FIGS. 3 and 4 illustrate a preferred embodiment of the invention in which the headgear is a hat, generally 30, which includes a crown 32 and a brim 34. Headgear indicia 36 on the side of crown 32 is positioned over a ball marker recess 38. As shown in FIG. 4, a ball marker 40 including marker indicia 42 on its outer planar surface is inserted into slit 38, completely covering indicia 36. Thus, as illustrated in FIG. 4, indicia 42 visually replaces indicia 36. Therefore, a complete indicia is visible whether or not marker 40 is present.

Figure 5:
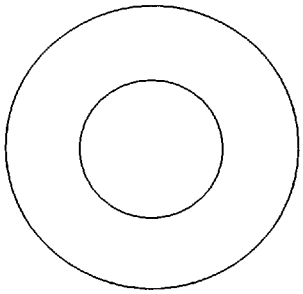
FIG. 5 is an enlarged front view of the ball marker shown in FIG. 2.
Figure 6:
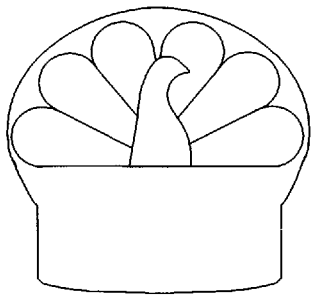
FIG. 6 is an enlarged front view of the ball marker shown in FIG. 4.

Enlarged ball markers 20 and 40 are illustrated in FIGS. 5 and 6, respectively.

Figure 7:
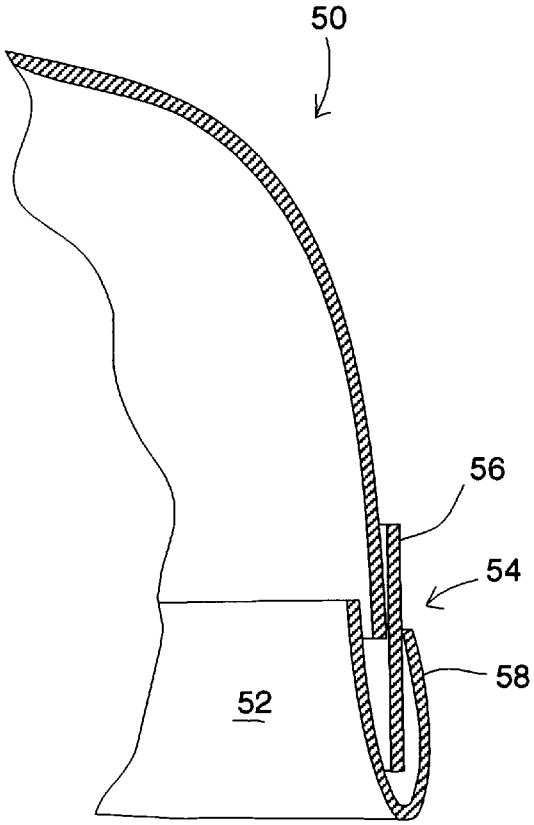
FIG. 7 is a sectional view of a headgear crown showing use of the headgear band as a ball marker recess.
Figure 8:
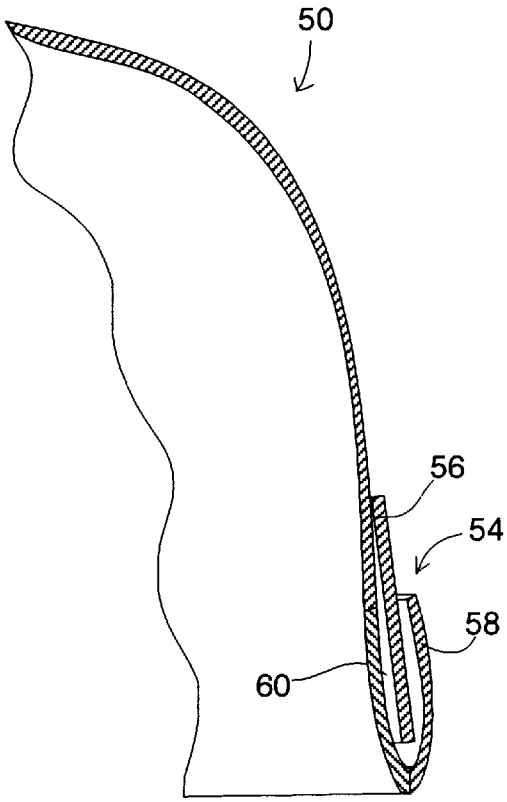
FIG. 8 is a sectional view of a headgear crown with a fabric section added to form a pocket.

FIG. 7 is a section edge view of a representative headgear 50 to show a band 52 in relation to slit or opening 54. As shown, when marker 56 is inserted into opening 54, the lower end of marker 56 is supported between band 52 and the inside of the lower part of crown 58. An alternative design is shown in FIG. 8, in which a pocket 60 inside crown 58, with the mouth of pocket 60 sewn to the edge of opening 54.

Certain modifications and improvements will occur to those skilled in the art upon a reading of the foregoing description. Such modifications and improvements have been deleted herein for the sake of conciseness and readability but are properly within the scope of the follow claims.

What is claimed is:

1. Headgear and ball marker assembly comprising:

a) headgear including a crown with a front and sides, said crown having an opening to receive a ball marker and a first indicia positioned over said opening; and b) a ball marker insertable into said opening, said marker having a second indicia thereon compatible with at least a part of said first indicia.

2. The assembly of claim 1, wherein said opening is located in a side of said crown.

3. The assembly of claim 1, wherein said headgear further includes a band around the interior of said crown, said band forming a marker receptacle beneath said opening.

4. The assembly of claim 1, wherein said headgear includes a bill projecting from the front of said headgear.

5. The assembly of claim 1, wherein said first indicia includes an upper segment above said opening.

6. The assembly of claim 5, wherein said second indicia is the same as said upper segment of said first indicia.

7. The assembly of claim 5, wherein said second indicia is the same as a part of the upper segment of said first indicia.

8. The assembly of claim 1, wherein said first indicia is sewn onto said headgear.

9. The assembly of claim 1, wherein said first indicia is printed onto said headgear.

10. The assembly of claim 1, wherein said ball marker includes a planar outer face and said second indicia is printed on said face.

11. Headgear including a ball marker comprising:

a) a crown including a lower peripheral edge, and a generally horizontal ball marker slit above said edge;

b) a first indicia on said headgear, said first indicia including an upper segment above said slit; and c) a ball marker insertable into said opening, said marker having a second indicia thereon compatible with at least a part of the upper segment of said first indicia.

12. The headgear of claim 11, wherein said headgear further includes a pocket inside said crown, said pocket having an upper opening in communication with said slit.

13. The headgear of claim 11, wherein said headgear includes a circumferential band having a lower edge joined to the lower peripheral edge of said crown, and an upper edge above said slit, whereby said ball marker when inserted downwardly into said slit will be positioned between said band and said crown.

14. The headgear of claim 11, wherein said band is attached to said crown at the sides of said slit.

15. The headgear of claim 11, wherein said ball marker includes opposed planar surfaces, each of said surfaces including a second indicia corresponding to at least a part of said first indicia.

16. A golf cap including a ball marker comprising:

a) a crown having a continuous lower edge, a front section and opposed side sections, one of said side sections including a generally horizontal slit of a first given width, said crown including a first indicia with an upper segment above said slit; and b) a ball marker inserted into said slit, said ball marker having opposed planar faces with a second given width approximately equal to said slit first given width, at least one of said faces including a second indicia identical to at least a part of the upper segment of said first indicia.

17. The cap of claim 16, wherein said first indicia is selected from the group consisting of logos and trademarks.

18. The cap of claim 17, wherein said first indicia is the logo of a broadcast network.

19. The cap of claim 16, wherein said ball marker includes an upper segment extending above said slit when said marker is inserted into said slit, said upper segment including a second indicia corresponding to at least a part of the upper segment of said first indicia.

20. The cap of claim 16, further including a ball marker receptacle inside said crown beneath said slit.

* * * * *